US011267677B2

(12) United States Patent
Ruhnke et al.

(10) Patent No.: US 11,267,677 B2
(45) Date of Patent: Mar. 8, 2022

(54) ELEVATOR ELECTRICAL SAFETY ACTUATOR CONTROL

(71) Applicant: Otis Elevator Company, Farmington, CT (US)

(72) Inventors: Jan Ruhnke, Berlin (DE); Helge Krambeck, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 303 days.

(21) Appl. No.: 16/552,354

(22) Filed: Aug. 27, 2019

(65) Prior Publication Data

US 2020/0071129 A1 Mar. 5, 2020

(30) Foreign Application Priority Data

Aug. 30, 2018 (EP) ..... 18191699

(51) Int. Cl.

| | |
|---|---|
| ***B66B 5/18*** | (2006.01) |
| ***B66B 9/00*** | (2006.01) |
| ***B66B 1/34*** | (2006.01) |
| ***B66B 1/36*** | (2006.01) |
| ***B66B 5/22*** | (2006.01) |

(52) U.S. Cl.

CPC ..... *B66B 5/18* (2013.01); *B66B 1/3461* (2013.01); *B66B 1/36* (2013.01); *B66B 9/00* (2013.01); *B66B 5/22* (2013.01)

(58) Field of Classification Search

CPC ..... B66B 5/18; B66B 1/36; B66B 1/3461
See application file for complete search history.

(56) References Cited

U.S. PATENT DOCUMENTS

| | | | |
|---|---|---|---|
| 3,961,688 | A | 6/1976 | Maynard |
| 4,256,204 | A | 3/1981 | Ando et al. |
| 4,316,097 | A | 2/1982 | Reynolds |
| 5,175,400 | A | 12/1992 | Hirabayashi et al. |

(Continued)

FOREIGN PATENT DOCUMENTS

| | | | |
|---|---|---|---|
| CN | 85109574 | A | 10/1987 |
| CN | 2592605 | Y | 12/2003 |

(Continued)

OTHER PUBLICATIONS

European Search Report for European Application No. 18191699.0, International Filing Date Aug. 30, 2018, dated Mar. 15, 2019, 7 pages.

(Continued)

*Primary Examiner* — Diem M Tran
(74) *Attorney, Agent, or Firm* — Cantor Colburn LLP

(57) ABSTRACT

Elevator systems and methods are provided. The systems include a traveling component movable along a guide rail within an elevator shaft, an elevator machine operably connected to the traveling component and including a machine brake, and an overspeed safety system. The overspeed safety system includes a safety brake and an electromechanical actuator, the brake engageable with the guide rail. A safety system controller operably connects to the electromechanical actuator and triggers the electromechanical actuator due to at least a detected triggering event. A temporary power supply is operably connected to the overspeed safety system to provide power in the event of a power failure.

19 Claims, 8 Drawing Sheets

(56) References Cited

U.S. PATENT DOCUMENTS

| | | | | |
|---|---|---|---|---|
| 5,229,558 | A | 7/1993 | Hakala | |
| 6,435,312 | B2 | 8/2002 | Tajima et al. | |
| 7,398,864 | B2 | 7/2008 | Chida | |
| 7,614,481 | B2 * | 11/2009 | Okamoto | B66B 5/06 187/305 |
| 7,650,968 | B2 | 1/2010 | Oesterle et al. | |
| 7,928,744 | B2 | 4/2011 | Price et al. | |
| 9,126,804 | B2 | 9/2015 | Widmer | |
| 9,938,115 | B2 | 4/2018 | Gewinner et al. | |
| 10,889,468 | B2 * | 1/2021 | Hu | B66B 5/02 |
| 2007/0056806 | A1 | 3/2007 | Okamoto et al. | |
| 2013/0240301 | A1 | 9/2013 | Antti et al. | |
| 2017/0073191 | A1 | 3/2017 | Thumm et al. | |
| 2017/0283215 | A1 | 10/2017 | Hu | |
| 2020/0130985 | A1 * | 4/2020 | Ruhnke | B66B 5/18 |
| 2020/0270098 | A1 * | 8/2020 | Mustafa | B66B 9/00 |

FOREIGN PATENT DOCUMENTS

| | | | |
|---|---|---|---|
| CN | 1845869 | A | 10/2006 |
| CN | 105314491 | B | 2/2016 |
| CN | 107021396 | A | 8/2017 |
| CN | 107108154 | A | 8/2017 |
| CN | 206665917 | U | 11/2017 |
| CN | 107434196 | A | 12/2017 |
| CN | 207483106 | U | 6/2018 |
| GB | 400157 | A | 10/1933 |
| JP | H01256480 | A | 10/1989 |
| JP | H04235877 | A | 8/1992 |
| JP | 2000053338 | A | 2/2000 |
| JP | 2005096881 | A | 4/2005 |
| KR | 100897833 | B1 | 5/2009 |
| WO | 2010056260 | A1 | 5/2010 |

OTHER PUBLICATIONS

European Office Action for European Application No. 18191699.0, International Filing Date Aug. 30, 2018, dated May 18, 2021, 5 pages.

* cited by examiner

ELEVATOR ELECTRICAL SAFETY ACTUATOR CONTROL

CROSS REFERENCE TO RELATED APPLICATIONS

This application claims the benefit of European Application No. 18191699.0, filed Aug. 30, 2018, which is incorporated herein by reference in its entirety.

BACKGROUND

The subject matter disclosed herein generally relates to elevator systems and, more particularly, to safety systems for elevators and control thereof in the event of a power failure.

Typical elevator systems use governor overspeed systems coupled to a mechanical safety actuation module in order to activate in the event of a car overspeed event, car overacceleration event, or free fall—i.e., to stop an elevator car that is travelling too fast. Such systems include a linking mechanism to trigger two car safeties simultaneously (i.e., on both guide rails). The governor is located either at the top of the hoistway or may be embedded on the elevator car. The safety actuation module is typically made by a rigid bar or linkage that is located on the car roof or below the car platform—i.e., spanning the width of the elevator car to link opposing sides at the guide rails. However, recent developments have created electrical overspeed safety systems for controlling operation of the elevator car during overspeed, overacceleration, free fall situations.

BRIEF SUMMARY

According to some embodiments, elevator systems are provided. The elevator systems include a traveling component movable along a guide rail within an elevator shaft, an elevator machine operably connected to the traveling component by one or more tension members, the elevator machine including a machine brake for stopping movement of the traveling component, and an overspeed safety system. The overspeed safety system includes a safety brake and an electromechanical actuator operably connected thereto, wherein the safety brake is operable to engage with the guide rail to stop movement of the traveling component, a safety system controller operably connected to the electromechanical actuator, the control system configured to trigger the electromechanical actuator due to at least a detected triggering event, and a temporary power supply operably connected to the overspeed safety system. During a power failure to the overspeed safety system, the temporary power supply supplies power to the overspeed safety system to prevent actuation of the safety brake and the elevator machine stops the traveling component within the elevator shaft. The safety system controller is configured to transition the electromechanical actuator from a first state to a second state, wherein in the second state, downward movement of the traveling component within the elevator shaft engages the safety brake with the guide rail to stop the downward movement of the traveling component.

In addition to one or more of the features described above, or as an alternative, further embodiments may include that the electromechanical actuator includes a first magnetic element and a second magnetic element. The first magnetic element is configured to retain the second magnetic element thereto, and when the second magnetic element is not retained by the first magnetic element the second magnetic element is engageable with the guide rail.

In addition to one or more of the features described above, or as an alternative, further embodiments may include that when the second magnetic element is engaged with the guide rail, downward movement of the traveling component causes the safety brake to engage with the guide rail.

In addition to one or more of the features described above, or as an alternative, further embodiments may include that wherein the first magnetic element is an electromagnetic coil and the second magnetic element is a permanent magnet.

In addition to one or more of the features described above, or as an alternative, further embodiments may include that an elevator controller and a communication bus operably connecting the safety system controller with the elevator controller, wherein detection of the power failure is transmitted from the elevator controller to the safety system controller over the communication bus.

In addition to one or more of the features described above, or as an alternative, further embodiments may include that the temporary power supply is configured to supply power to the overspeed safety system for a safety duration, preferably, wherein the safety duration is at least 3 seconds.

In addition to one or more of the features described above, or as an alternative, further embodiments may include that at the end of the safety duration the second magnetic element is transitioned to the second state.

In addition to one or more of the features described above, or as an alternative, further embodiments may include an additional guide rail, an additional safety brake, and an additional electromechanical actuator operably connected thereto, wherein the additional safety brake is simultaneously operable with the safety brake to engage with the additional guide rail to stop movement of the traveling component.

In addition to one or more of the features described above, or as an alternative, further embodiments may include that the traveling component is one of an elevator car and a counterweight.

According to some embodiments, methods for controlling operation of elevator systems are provided. The methods include detecting a power failure, supplying power from a temporary power supply to an overspeed safety system, applying a machine brake to stop movement of a traveling component, and transitioning an overspeed safety system from a first state to a second state, wherein in the second state, further downward movement of the traveling component within an elevator shaft engages a safety brake of the overspeed safety system with a guide rail to stop the downward movement of the traveling component.

In addition to one or more of the features described above, or as an alternative, further embodiments may include supplying power from the temporary power supply to the overspeed safety system for a safety duration, preferably, wherein the safety duration is at least 3 seconds.

In addition to one or more of the features described above, or as an alternative, further embodiments may include that at the end of the safety duration the second magnetic elements are transitioned to the second state.

In addition to one or more of the features described above, or as an alternative, further embodiments may include transitioning the overspeed safety system from the second state to a third state when the traveling component moves downward, wherein in the third state a safety brake of the overspeed safety system engages with a guide rail to stop downward movement of the traveling component.

In addition to one or more of the features described above, or as an alternative, further embodiments may include transmitting information regarding a power failure from an elevator controller to the overspeed safety system over a communication bus.

In addition to one or more of the features described above, or as an alternative, further embodiments may include, when power is restored, transitioning the overspeed safety system from the second state to the first state and resuming normal operation of the traveling component.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited by the accompanying figures in which like reference numerals indicate similar elements.

DETAILED DESCRIPTION

Figure 1:
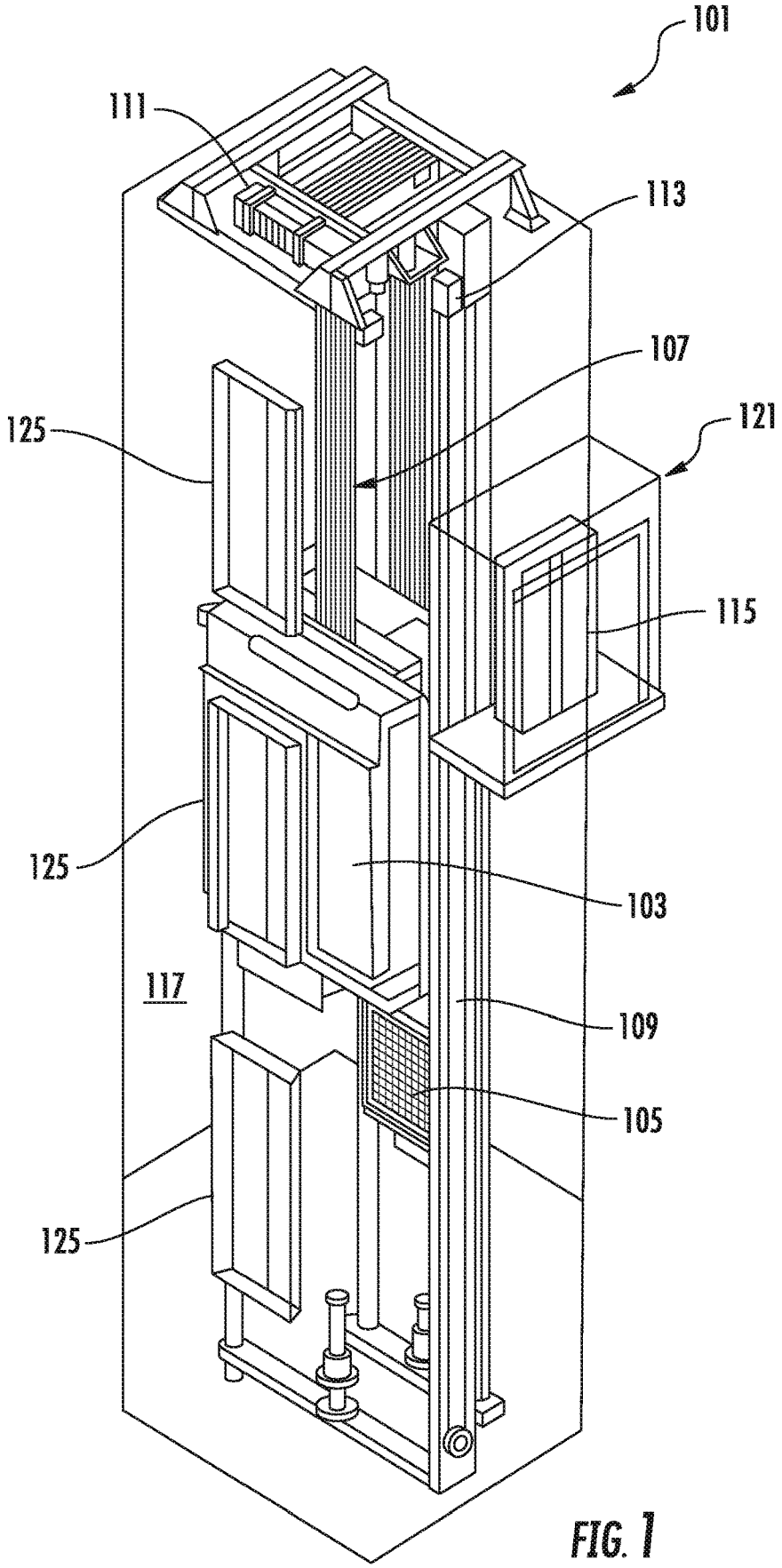
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and an elevator controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109. As used herein, the term "traveling component" refers to either of the elevator car 103 or the counterweight 105.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter-weight, as known in the art. For example, without limitation, the position reference system 113 can be an encoder, sensor, or other system and can include velocity sensing, absolute position sensing, etc., as will be appreciated by those of skill in the art.

The elevator controller 115 is located, as shown, in a controller room 121 of the elevator shaft 117 and is configured to control the operation of the elevator system 101, and particularly the elevator car 103. For example, the elevator controller 115 may provide drive signals to the machine 111 to control the acceleration, deceleration, leveling, stopping, etc. of the elevator car 103. The elevator controller 115 may also be configured to receive position signals from the position reference system 113 or any other desired position reference device. When moving up or down within the elevator shaft 117 along guide rail 109, the elevator car 103 may stop at one or more landings 125 as controlled by the elevator controller 115. Although shown in a controller room 121, those of skill in the art will appreciate that the elevator controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figure 2:
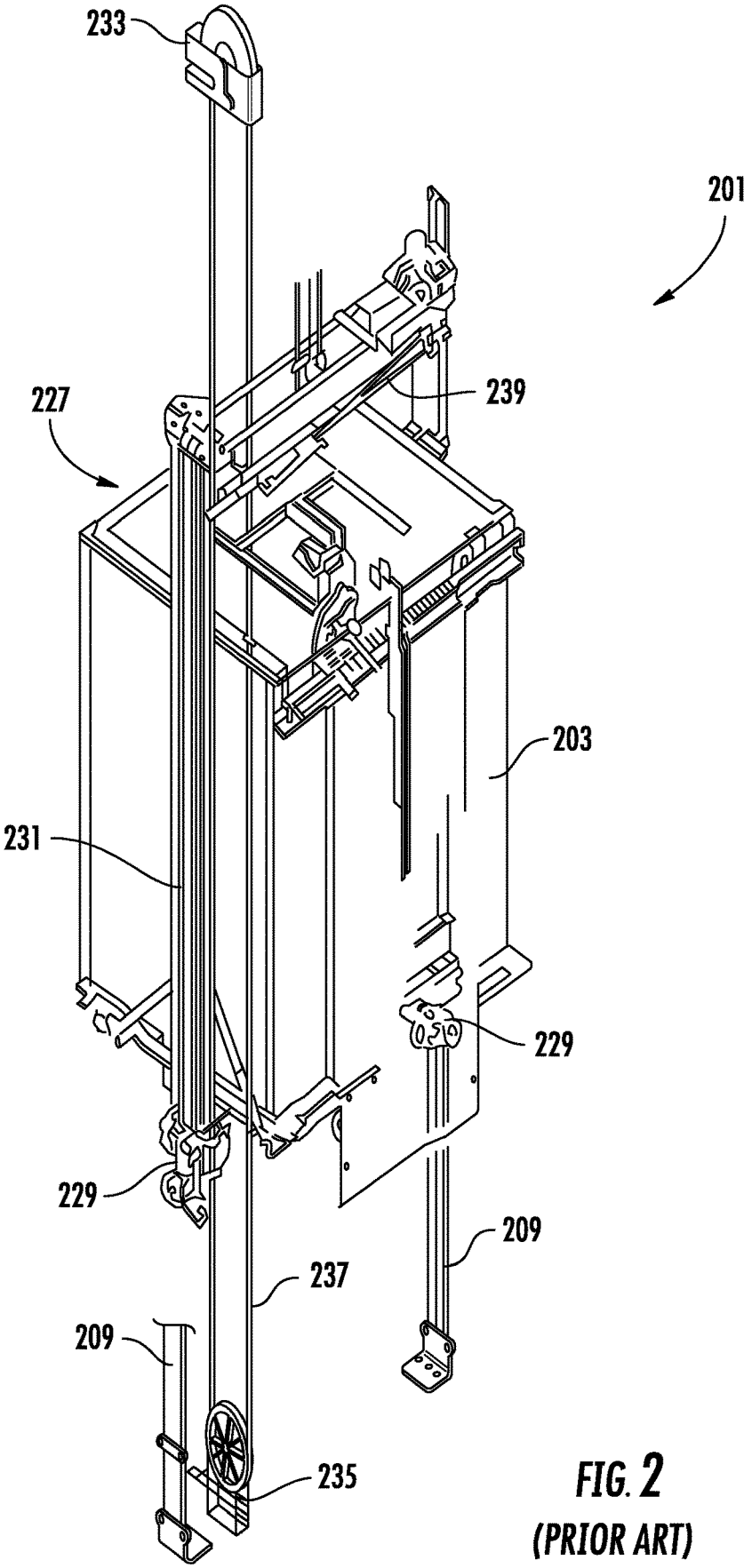
FIG. 2 (PRIOR ART)
FIG. 2 is a prior art arrangement of an overspeed safety system for elevators.

Turning to FIG. 2, a schematic illustration of a prior elevator car overspeed safety system 227 of an elevator system 201 is shown. The elevator system 201 includes an elevator car 203 that is movable within an elevator shaft along guide rails 209. In this illustrative embodiment, the overspeed safety system 227 includes a pair of braking elements 229 that are engageable with the guide rails 209. The braking elements 229 are actuated, in part, by operation of lift rods 231. The triggering of the braking elements 229 is achieved through a governor 233, typically located at the top of the elevator shaft, which includes a tension device 235 located within the pit of the elevator shaft with a cable 237 operably connecting the governor 233 and the tension device 235. When an overspeed event is detected by the governor, the overspeed safety system 227 is triggered, and a linkage 239 is operated to actuate both lift rods 231 simultaneously such that a smooth and even stopping or braking force is applied to stop the travel of the elevator car. The linkage 239, as shown, is located on the top of the elevator car 203. However, in other configurations, the linkage may be located below a platform (or bottom) of the elevator car. As shown, various components are located above and/or below the elevator car 203, and thus pit space and overhead space within the elevator shaft must be provided to permit operation of the elevator system 201.

Embodiments described herein are directed to providing electrical elevator overspeed safety systems that are primed but not fully engaged in the event of a power failure. Instead, embodiments of the present disclosure employ a temporary power supply to stop an elevator car using an elevator machine and machine brake, and subsequently prime the operation of the electrical overspeed safety systems. In the primed state, if further downward movement of the elevator car occurs, the overspeed safety systems may activate and engage to securely stop the elevator car. However, if power is resumed without further downward movement, the elevator system may immediately return to normal operational mode, without the need for manual interaction that may have resulted from full deployment of the overspeed safety systems.

Figure 3A:
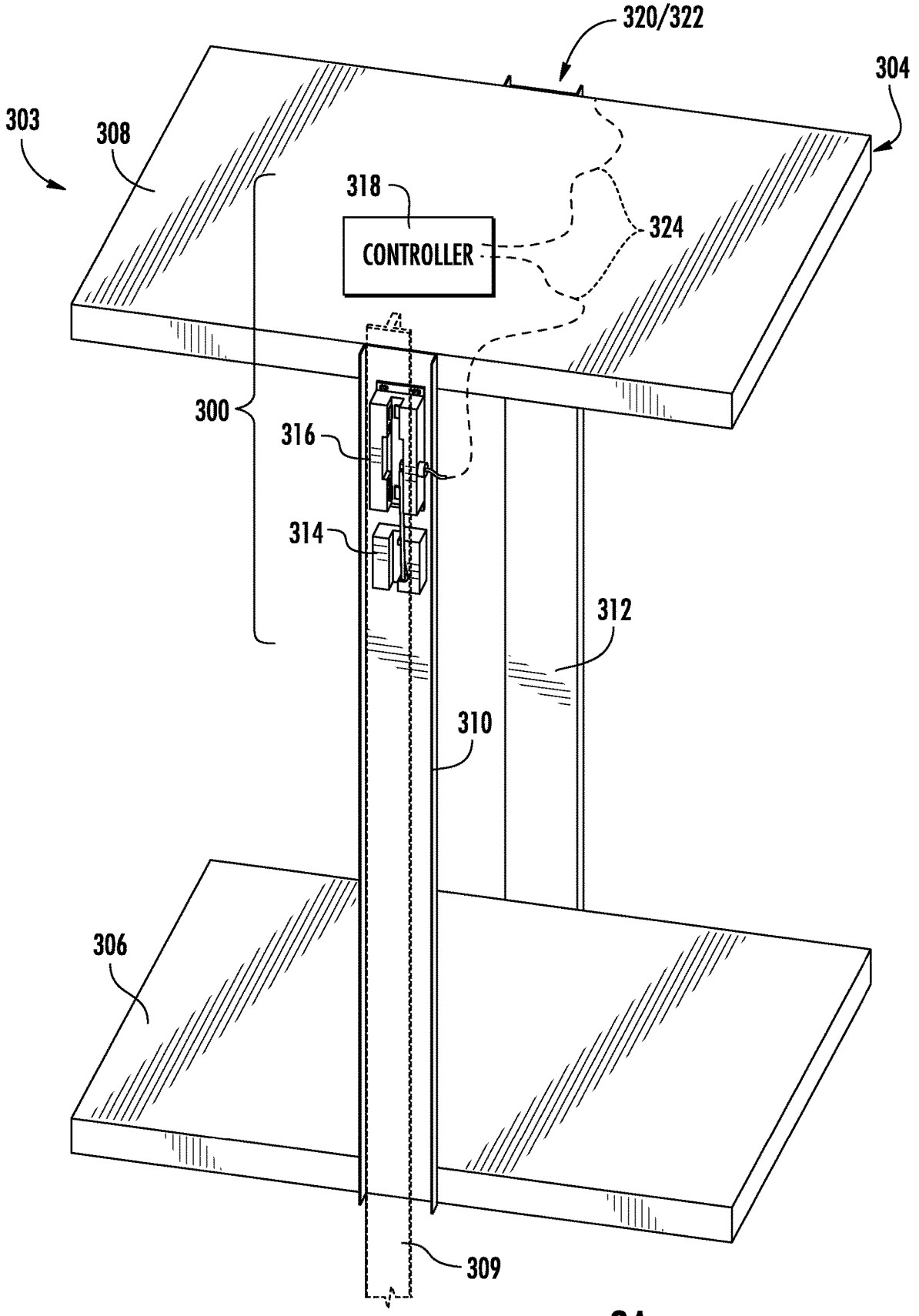
FIG. 3A is an isometric illustration of an elevator car frame having an overspeed safety system in accordance with an embodiment of the present disclosure.
Figure 3B:
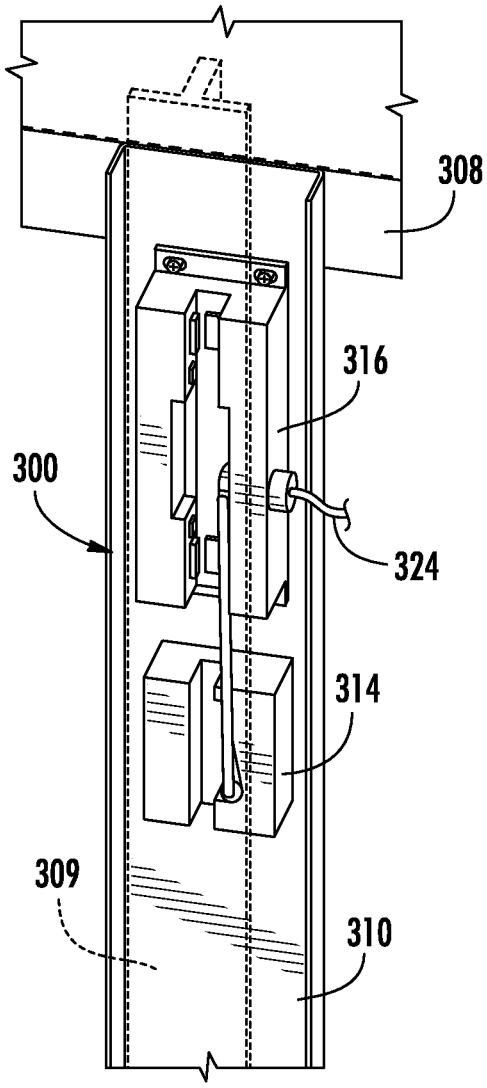
FIG. 3B is an enlarged illustrative view of a portion of the overspeed safety system of FIG. 3A.
Figure 3C:
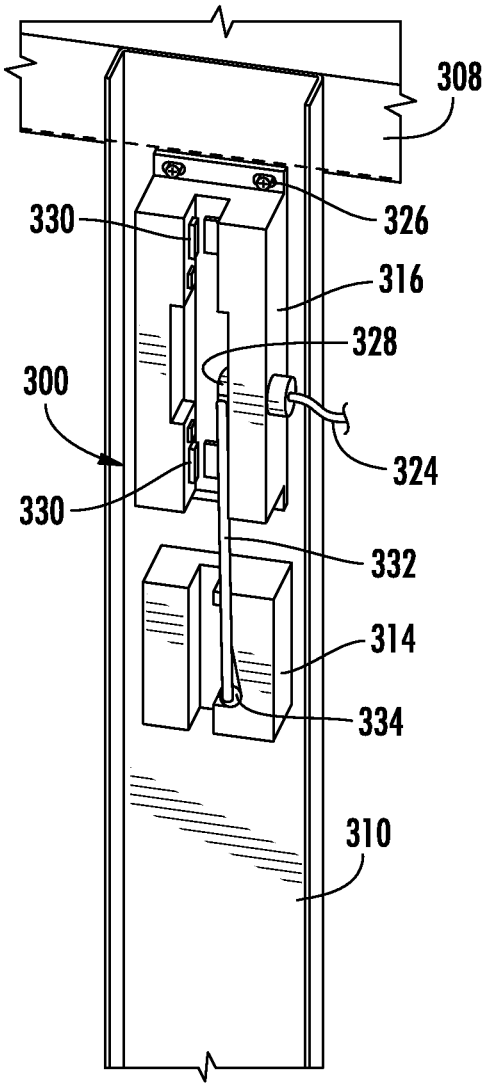
FIG. 3C is the same view as FIG. 3B, but with a guide rail removed for clarity.

Turning now to FIGS. 3A-3C, schematic illustrations of an elevator car 303 having an overspeed safety system 300 in accordance with an embodiment of the present disclosure are shown. FIG. 3A is an isometric illustration of an elevator car frame 304 with the overspeed safety system 300 installed thereto. FIG. 3B is an enlarged illustration of a portion of the overspeed safety system 300 showing a relationship with a guide rail. FIG. 3C is a schematic similar to FIG. 3B, but with the guide rail removed for clarity of illustration.

The car frame 304 includes a platform 306, a ceiling 308, a first car structural member 310, and a second car structural member 312. The car frame 304 defines a frame for supporting various panels and other components that define the elevator car for passenger or other use (i.e., define a cab of the elevator), although such panels and other components are omitted for clarity of illustration. The elevator car 303 is moveable along guide rails 309, similar to that shown and described above. The overspeed safety system 300 provides a safety braking system that can stop the travel of the elevator car 303 during an overspeed event.

The overspeed safety system 300 includes a first safety brake 314, a first electromechanical actuator 316, and a control system or safety system controller 318 operably connected to the first electromechanical actuator 316. The first safety brake 314 and the first electromechanical actuator 316 are arranged along the first car structural member 310. A second safety brake 320 and a second electromechanical actuator 322 are arranged along the second car structural member 312. The safety system controller 318 is also operably connected to the second electromechanical actuator 322. The connection between the safety system controller 318 and the electromechanical actuators 316, 322 may be provided by a communication line 324. The communication line 324 may be wired or wireless, or a combination thereof (e.g., for redundancy). As shown, the safety system controller 318 is located on the top or ceiling 308 of the car frame 304. However, such position is not to be limiting, and the safety system controller 318 may be located anywhere within the elevator system (e.g., on or in the elevator car, within a controller room, etc.). The safety system controller 318 may comprise electronics and printed circuit boards for processing (e.g., processor, memory, communication elements, electrical buss, etc.). Thus, the safety system controller 318 may have a very low profile and may be installed within ceiling panels, wall panels, or even within a car operating panel of the elevator car 303.

The overspeed safety system 300 is an electromechanical system that eliminates the need for a linkage or linking element installed at the top or bottom of the elevator car. The safety system controller 318 may include, for example, a printed circuit board with multiple inputs and outputs. In some embodiments, the safety system controller 318 may include circuitry for a system for control, protection, and/or monitoring based on one or more programmable electronic devices (e.g., power supplies, sensors, and other input devices, data highways and other communication paths, and actuators and other output devices, etc.). The safety system controller 318 may further include various components to enable control in the event of a power outage (e.g., capacitor/battery, etc.). The safety system controller 318 may also include an accelerometer and/or absolute position reference system to determine a speed of an elevator car. In such embodiments, the safety system controller 318 is mounted to the elevator car, as shown in the illustrative embodiments herein.

The safety system controller 318, in some embodiments, may be connected to and/or in communication with a car positioning system, an accelerometer mounted to the car (i.e., a second or separate accelerometer), and/or to the elevator controller. Accordingly, the safety system controller 318 may obtain movement information (e.g., speed, direction, acceleration) related to movement of the elevator car along an elevator shaft. The safety system controller 318 may operate independently of other systems, other than potentially receiving movement information, to provide a safety feature to prevent overspeed events.

The safety system controller 318 may process the movement information provided by a car positioning system to determine if an elevator car is over speeding beyond a certain threshold or accelerating beyond a threshold. If the threshold is exceeded, the safety system controller 318 will trigger the electromechanical actuators and the safety brakes. The safety system controller 318 will also provide feedback to the elevator control system about the status of the overspeed safety system 300 (e.g., normal operational position/triggered position).

Although FIG. 3 is illustratively shown with respect to an elevator car, the configuration of the overspeed safety system may be similar to any traveling component (e.g., counterweight). The overspeed safety system 300 of the present disclosure enables electrical and electromechanical safety braking in the event of overspeed, overacceleration, and/or free fall events (hereinafter "triggering events"). The electrical aspects of the present disclosure enable the elimination of the physical/mechanical linkages that have traditionally been employed in overspeed safety systems. That is, the electrical connections allow for simultaneous triggering of two separate safety brakes through electrical signals, rather than relying upon mechanical connections.

With reference to FIG. 3C, details of parts of the overspeed safety system 300 are shown. The first electromechanical actuator 316 is mounted to the first car structural member 310 using one or more fasteners 326 (e.g., floating fasteners). The first electromechanical actuator 316 includes an actuator element 328 and guidance elements 330. The first electromechanical actuator 316 is operably connected to the safety system controller 318 by the communication line 324. The safety system controller 318 can transmit an actuation signal to the first electromechanical actuator 316 (and the second electromechanical actuator 322) to perform an actuation operation when a triggering event is detected. The first electromechanical actuator 316 will actuate a connecting rod 332 that is operably connected to the first safety brake 314. When the connecting rod 332 is actuated, the first safety brake 314 will actuate to engage with the guide rail 309, e.g., using a safety brake element 334, such as a safety roller or wedge. In some embodiments, the safety brake and the electromechanical actuator may be combined into a single assembly, and the present illustration and description is provided for example and explanation only, and is not intended to be limiting.

Figure 4:
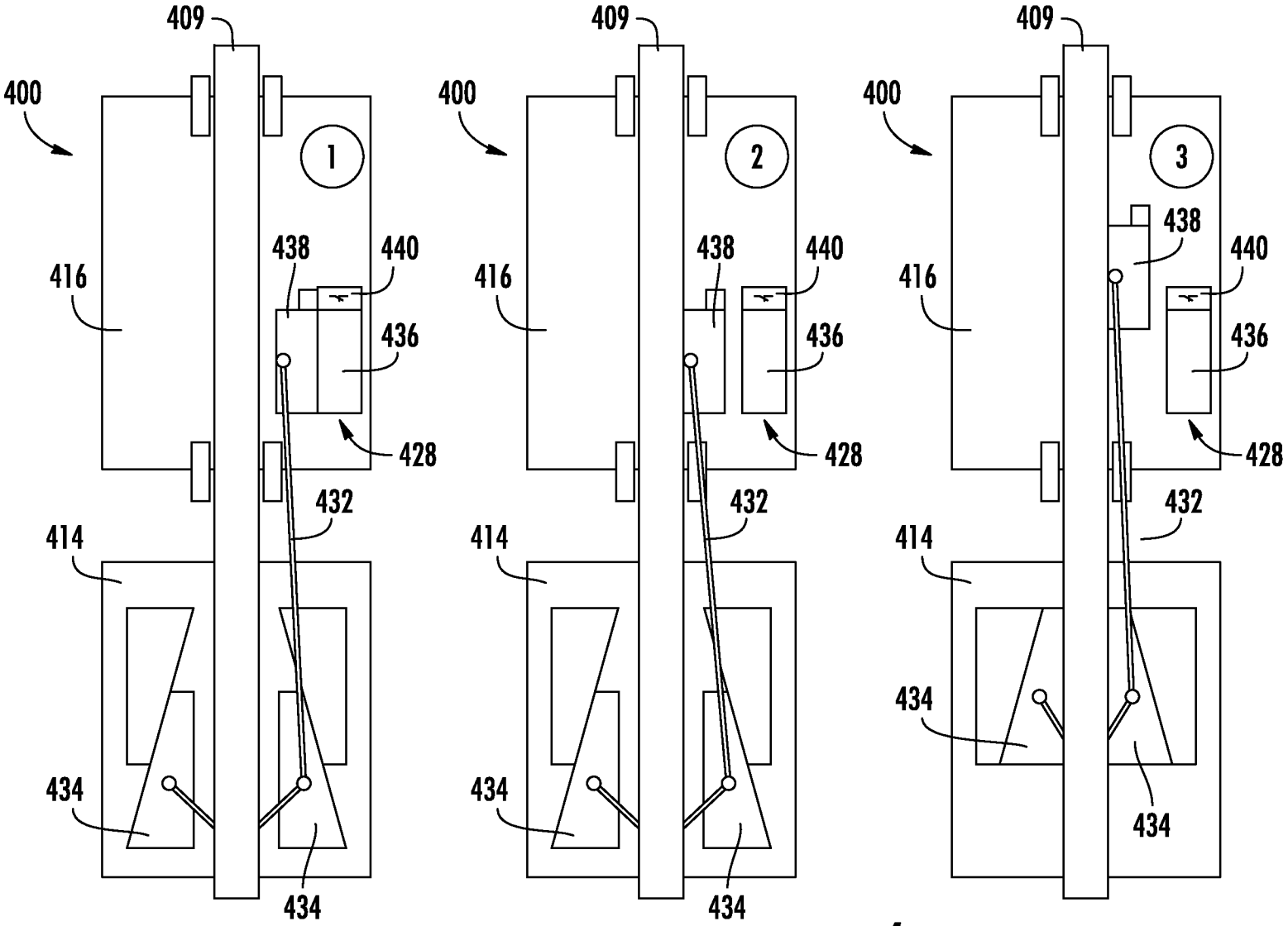
FIG. 4 is a series of illustrations depicting operation of a portion of an overspeed safety system in accordance with an embodiment of the present disclosure.

Turning now to FIG. 4, an illustrative sequence of operation of a portion of an overspeed safety system 400 in accordance with an embodiment of the present disclosure is shown. The overspeed safety system 400 may be similar to that described above, and operable as described above. The overspeed safety system 400 includes an electromechanical actuator 416 and a safety brake 414 connected by a connecting rod 432. The overspeed safety system 400 may be mounted to or otherwise attached to a traveling component (e.g., elevator car or counterweight). The safety brake 414 is arranged about a guide rail 409 and is configured to operably engage with the guide rail 409 to apply a braking force to a traveling component to which the overspeed safety system 400 is a part. The safety brake 414 includes safety brake elements 434 (e.g., brake pads, wedges, etc.) that are operable to engage with the guide rail 409. The electromechanical actuator 416 includes an actuator element 428 that is, in part, connected to the connecting rod 432 to actuate the safety brake elements 434.

In this illustrative embodiment, the actuator element 428 includes a first magnetic element 436, a second magnetic element 438, and a switch 440. The first magnetic element 436 may be an electromagnet (e.g., a coil) that generates a magnetic field to provide engagement with the second magnetic element 438. The second magnetic element 438 may be a permanent magnet. In some embodiments, the switch 440 is configured to monitor the position of the magnetic elements 436, 438. The switch 440 can be evaluated to control the safety chain signal to prevent normal operation of the traveling component in second (middle image of FIG. 4) and third (right image of FIG. 4) states, as described below. The states of the first and second magnetic elements 436, 438 are bi-stable and a current pulse is sent through the first magnetic element 436 for transitions between the first (left image of FIG. 4) and second (middle image of FIG. 4) states of the actuator element 428. The current direction is used to control the direction of transition (i.e., first-to-second, or second-to-first). In some such embodiments, the switch 440 may have no direct influence on the operation of the first and/or second magnetic elements 436, 438. Although shown and described with a specific configuration, the present illustration and explanation is provided for example and explanatory purposes and is not intended to be limiting.

In alternative embodiments, the switch 440 may be an active element related to the operation of the actuator element 428. For example, in some embodiments, when the switch 440 is closed, the first magnetic element 436 is active and generates a magnetic field to engage with the second magnetic element 438. This is a first state shown on the left image of FIG. 4. In the first state, normal operation of the traveling component is possible. The switch 440 may be part of the elevator system safety chain, and if the safety chain breaks, the switch 440 opens, as shown in the second state (middle image of FIG. 4). The above described operation is merely provided as example, and other arrangements are possible without departing from the scope of the present disclosure. For example, in some embodiments, an electrical current may be provided to the first magnetic element to generate a repulsive magnetic field, and thus urge the second magnetic element away therefrom.

When the switch 440 is open, the magnetic field of the first magnetic element 436 ceases to be generated, thus allowing the second magnetic element 438 to move into contact with and magnetically attach to the guide rail 409, as shown in the middle image of FIG. 4 (second state). That is, because the first magnetic element 436 is no longer magnetized (e.g., no current flowing through a coil), the second magnetic element 438 will be attracted to the metal of the guide rail 409 and magnetically adhere thereto. Accordingly, when no electrical power is supplied to the first magnetic element 436, the second magnetic element 438 will automatically engage with the guide rail 409.

The second state, shown in the middle image of FIG. 4, exists when the switch 440 opens and the traveling component is stationary. However, if the traveling component travels downward, because the second magnetic element 438 is engaged with the guide rail 409, the second magnetic element 438 will apply a force to the connecting rod 432 to urge the safety brake elements 434 into engagement with the guide rail 409 (third state). With the safety brake elements 434 engaged with the guide rail 409, the traveling component may be prevented from further downward movement.

In FIG. 4, the first state (left illustration) is a state wherein the second magnetic element 438 is engaged by the first magnetic element 436 which is only energized during transitions, and the switch 440 is closed. This is "a ready for trip" state of the overspeed safety system 400. In the second state (middle illustration), the first magnetic element 436 is not energized and the switch 440 is open, and the second magnetic element 438 is engaged with the guide rail 409. In the second state, the safety brake elements 434 have not moved and are not in engagement with the guide rail 409. This is a "pre-tripped" state of the overspeed safety system 400. In the third state (right illustration), the second magnetic element 438 is engaged with the guide rail 409, the switch 440 is open (and the first magnetic element 436 is not energized), and the safety brake elements 434 are engaged with the guide rail 409. This is a "tripped" state of the overspeed safety system 400.

The overspeed safety system should be fail-safe in the event of power failures, specifically the electrical and mechanical components should be arranged to provide safety, even in the event of a power failure. To achieve this, overspeed safety systems of the present disclosure are configured to transition to a safe state in case of power outage. For the overspeed safety systems, and particularly for electrical safety actuators, an issue may arise that a trip of safeties is required and can occur while the traveling component is moving. If the safety brake elements engage, such stopping can trap passengers at a location away from a landing door, and manual intervention may be required to rescue such passengers. Once engaged, the safety brake elements typically require manual intervention to disengage from the guide rail, which may require additional time and effort during rescue operations.

In accordance with embodiments of the present disclosure, a control system (and software thereof, e.g., on a safety actuator board) of an overspeed safety system may detect an under-voltage event on an input supply voltage. Immediately, upon detection of such under-voltage event, the control system will transmit a message to a controller of an electronic safety chain, to thus open the safety chain. In accordance with embodiments of the present disclosure, the safety chain controller contains a supply buffer (e.g., power support buffer) to keep the electronic safety actuator and/or overspeed safety system active and powered (along with attached sensors) for safety duration (e.g., a minimum of 3 seconds). The safety duration is typically sufficiently long enough to stop the traveling component by using the elevator machine. At the end of the safety duration, the overspeed safety system will be prepared to engage (pre-tripped) by the control system of the overspeed safety system. The power supply for the safety duration allows a controlled stop of the traveling component in case of power outages and prevents unnecessary stops by the overspeed safety system. Accordingly, if power is restored, and the elevator system returns to normal operation, no manual interaction is required to reset the overspeed safety system because the safety brake elements did not engage with the guide rail.

Figure 5:
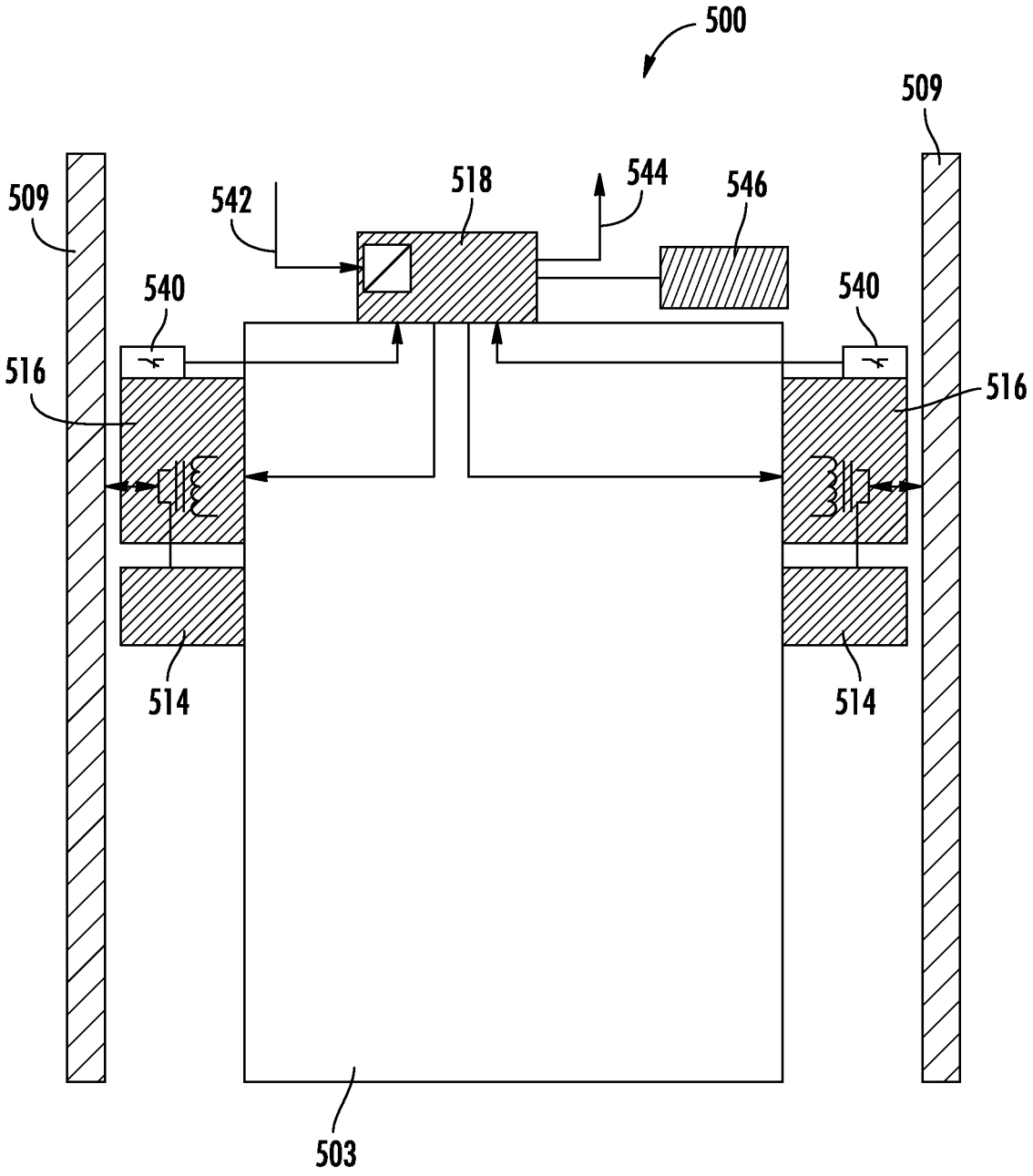
FIG. 5 is a schematic illustration of an elevator system having an overspeed safety system in accordance with an embodiment of the present disclosure.

Turning now to FIG. 5, a schematic illustration of a traveling component 503 having an overspeed safety system 500 in accordance with an embodiment of the present disclosure is shown. The overspeed safety system 500 includes a safety system controller 518 operably connected to optional switches 540, which in turn enable control/operation of electromechanical actuators 516 and safety brakes 514. The safety brakes 514 are operable to engage with respective guide rails 509, as described above. In some embodiments, the switches 540 may be removed or provided for monitoring purposes, with the system controller 518 directly connected to operation of the electromechanical actuators 516 and safety brakes 514.

As shown, the safety system controller 518 receives power through a power line 542 and communicates over a communication bus 544 (e.g., a car-CAN bus). The power line 542 and the communication bus 544 may be arranged on or as part of a traveling cable, as will be appreciated by those of skill in the art. Further, in some embodiments, the power line 542 and the communication bus 544 may be housed in the same cable, wiring, cord, etc. as will be appreciated by those of skill in the art. As shown, a motion detection system 546 is operably connected to the safety system controller 518 of the overspeed safety system 500. The motion detection system 546 is configured to detection position, speed, acceleration, or other movement characteristics of the elevator car 503. In some embodiments, the motion detection system 546 may be an absolute position reference system, although other types of position/motion detection may be employed without departing from the scope of the present disclosure.

Overspeed, overacceleration, and free fall events (i.e., triggering events) may be detected by the safety system controller 518 of the overspeed safety system 500 based on information provided by the motion detection system 546. The communication bus 544 enables interfacing of the overspeed safety system 500 with the other parts of the elevator system (e.g., elevator controller, elevator machine, etc.). A power failure may be reported via the communication bus 544 to the safety system controller 518 of the overspeed safety system 500. In some embodiments, the power failure may be directed detected by the safety system controller 518. The overspeed safety system 500 is configured to operate and function independently from the rest of the elevator system, e.g., the braking applied by the overspeed safety system 500 is separate and independent from machine braking or other braking systems of the elevator system. The overspeed safety system 500 of the present disclosure is configured to active the safety brakes only in emergency situations. However, typically, a power fail is not considered an emergency situation and therefore a loss of primary input power should not lead to tripping and activation of the safety brakes 514. That is, it is typically not desirable to have the safety brakes 514 stop the movement of the traveling component 503 during a power failure, as release of the safety brakes 514 requires manual interaction and thus the elevator system cannot return to normal operation with the restoration of power, if the safety brakes 514 have been activated and engaged (i.e., triggered).

Figure 6:
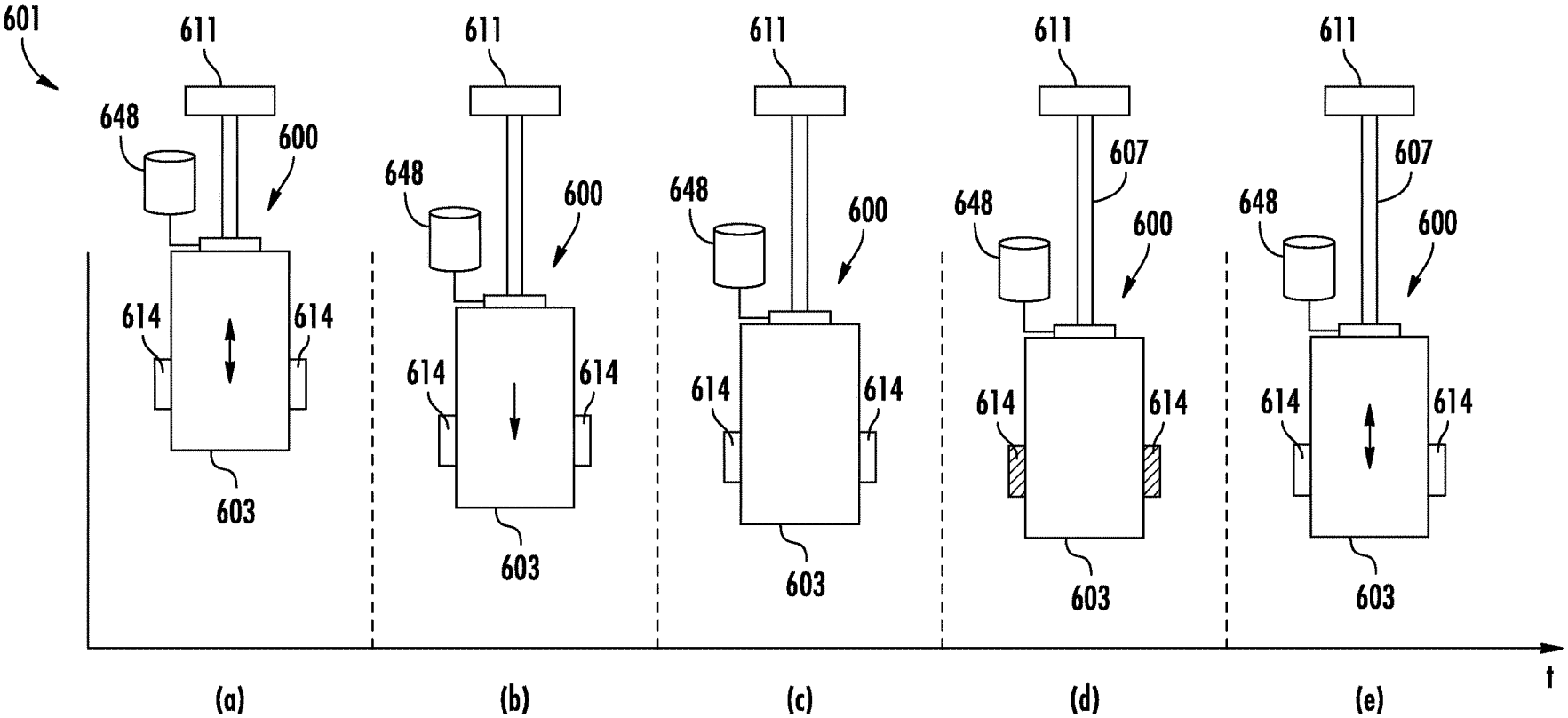
FIG. 6 is a series of illustrations depicting operation of an overspeed safety system in accordance with an embodiment of the present disclosure.

Turning to FIG. 6, schematic illustrations of operation of an elevator system 601 in accordance with an embodiment of the present disclosure. The elevator system 601 includes a traveling component 603 that runs within an elevator shaft and is suspended on one or more tension members 607, and movement is driven by a machine 611. The traveling component 603 is equipped with an overspeed safety system 600 similar to that shown and described above. The overspeed safety system 600 includes safety brakes 614 that are operable through a connection with respective electromechanical actuators, as described above.

In FIG. 6, step (a) represents normal operation of the traveling component 603. In normal operation, the traveling component 603 is movable upward and downward within the elevator shaft (e.g., to travel between landings of the elevator system 601).

Step (b) of FIG. 6 is representative of a power failure. At step (b) the traveling component 603 will travel downward, due to gravity and/or because the traveling component is already moving downward before power is lost. When the power fails, the machine 611 will not have a constant power supply to control operation of the traveling component 603. It is noted that even if only the power supply to the traveling component fails, e.g. due to a failure in a travelling cable, the elevator machine would be working under normal conditions. In this case, the traveling component is stopped after the safety chain has opened because the overspeed safety system detects and reports a power failure. However, in accordance with embodiments of the present disclosure, a temporary power supply 648 is electrically connected to or part of the overspeed safety system 600. The temporary power supply 648 may be a capacitor, a battery, or other energy storage device, as will be appreciated by those of skill in the art. The temporary power supply 648 is configured to store sufficient power to operate the overspeed safety system 600 for a safety duration. The safety duration, in some non-limiting embodiments, may be three seconds, although longer or shorter durations may be employed depending on the configuration of the temporary power supply 648 and/or the configuration of the elevator system 601 and the needs thereof.

The temporary power supply 648 enables the overspeed safety system 600 to prevent tripping of the permanent magnets as long as the traveling component is moving. Thus, the safety duration is typically a period of time that is longer than the maximum amount of time for the machine brake to stop movement of the traveling component under normal operation circumstances. The traveling component will be stopped by the machine brake of the machine 611 after the safety chain opens in the descent that occurs due to a power failure, as shown in step (c) of FIG. 6. The temporary power supply 648 may be depleted of reserve power in step (c), or may retain additional reserve power, if necessary or desired, and depending on the type of energy storage device. In this step, the overspeed safety system is in the first state, e.g., as shown in the left illustration of FIG. 4.

At step (d) of FIG. 6, the overspeed safety system primes or enters the second state (e.g., pre-tripped state), as shown in the middle illustration of FIG. 4. In this step (d), the machine 611 has stopped the travel of the traveling component 603, and holds the traveling component 603 in position. That is, a machine brake of the machine 611 will hold the traveling component 603 in a stopped position shown in step (d) of FIG. 6. Further, as noted, at the same time, the overspeed safety system is in the second state, with a second magnet engaged with a guide rail, as described above. However, in this state, the safety brakes 614 have not engaged with the guide rails.

At step (e), if power is returned to the system, the traveling component 603 may resume normal operation, as shown (up and down movement driven by operation of the machine 611). There is no need for a mechanic or other personal to manually disengage the safety brakes 614 from the guide rails, as the safety brakes 614 were never activated.

If however, during the power failure, such as at step (d), with the overspeed safety system in the second state, if the traveling component 603 travels downward for any reason, the safety brakes 614 will be tripped and transition the overspeed safety system into the third state, with the safety brakes 614 engaged with the guide rails.

Figure 7:
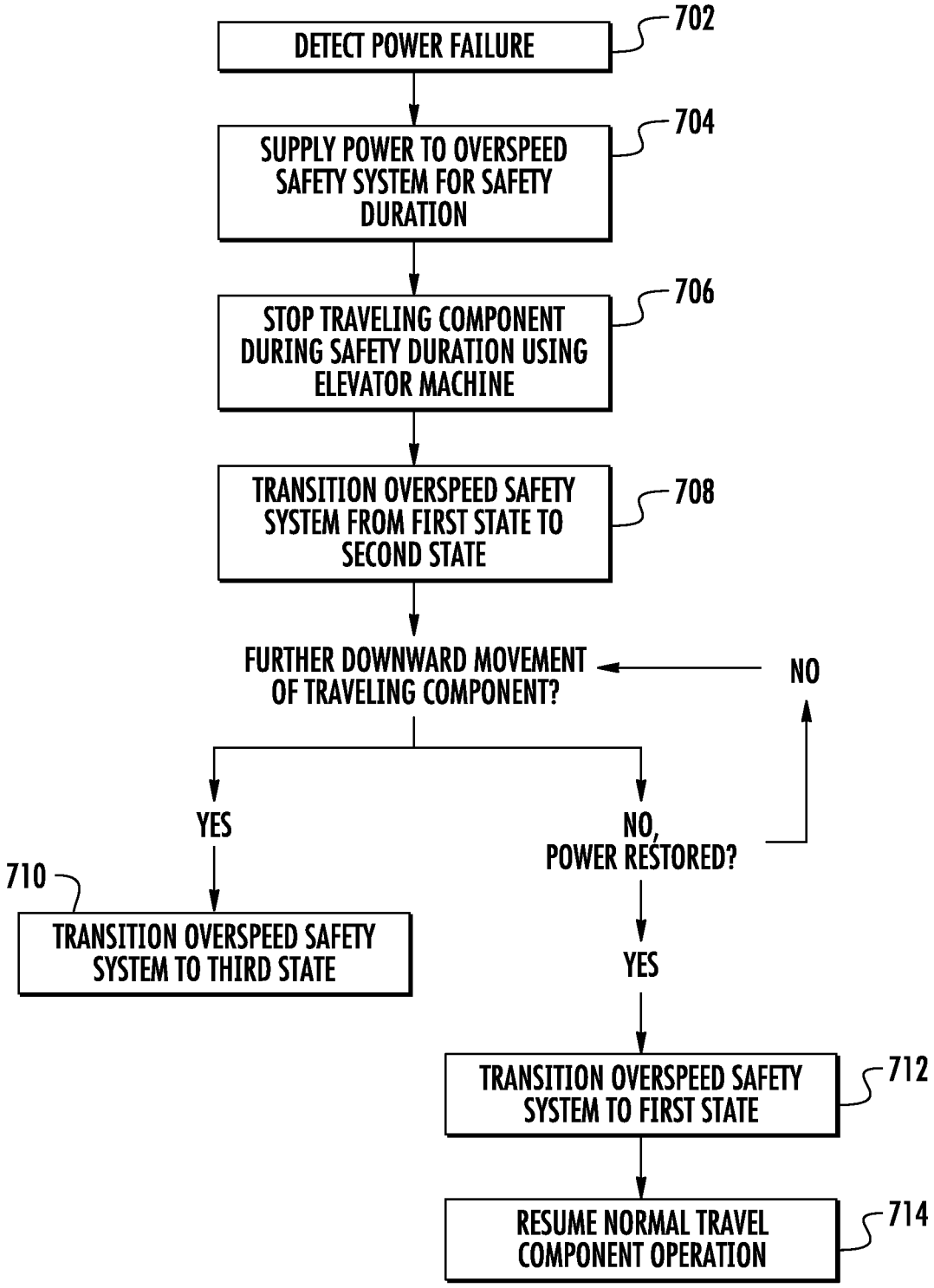
FIG. 7 is a flow process for controlling operation of an elevator car in accordance with an embodiment of the present disclosure.

Turning now to FIG. 7, a flow process for operation an elevator system in accordance with an embodiment of the present disclosure is shown. The elevator system may include an elevator machine and an overspeed safety system, along with other components, as shown and described above.

At block 702, a power failure is detected.

At block 704, power is supplied to the overspeed safety system from a temporary power supply. The power supplied from the temporary power supply is provided to the overspeed safety system to prevent operation of the overspeed safety system (i.e., prevent engagement of the emergency braking system), in the event of a power failure. The elevator machine will brake to stop travel of the traveling component, without the emergency overspeed safety system applying safety brakes unnecessarily. The temporary power supply, as noted above, may be configured to supply power for a safety duration. In some embodiments, the safety duration is three seconds (or longer). The safety duration is a duration of time that is sufficient for the elevator machine to stop travel of a moving traveling component without application or triggering engagement of the braking by the overspeed safety system.

At block 706, the traveling component is stopped and suspended from tension members and held in place, at least in part, by the machine brake of the elevator machine.

At block 708, the overspeed safety system is transitioned from a first state (normal elevator operation, e.g., as shown in the left illustration of FIG. 4) to a second state, which is primed for safety braking, if needed (e.g., as shown in the middle illustration of FIG. 4). After block 708, and the overspeed safety system being in the second state, the movement of the elevator car and the power of the system impact the following actions.

For example, if the traveling component travels downward after block 708, the overspeed safety system will automatically transition to the third state (e.g., as shown in the right illustration of FIG. 4), at block 710. In the third state, safety brakes are engaged with guide rails to prevent further movement of the traveling component.

However, if no further downward movement occurs, the power of the system will dictate the next action. For example, if power is restored, and no downward movement of the elevator occurs, the overspeed safety system will transition from the second state back to the first state, at block 712. If the power is not restored, the system remains in the state after block 708, waiting for either power restoration or further downward movement of the traveling component.

At block 714, with the overspeed safety system in the first state again, the traveling component will return to normal operation.

If block 710 is triggered due to downward movement of the traveling component, and the safety brakes engage with the guide rails, a manual interaction or operation will be required to be performed to reset the overspeed safety system, and to enable normal operation of the traveling component. However, such manual interaction is minimized due to embodiments of the present disclosure that do not fully engaging the safety brakes of the overspeed safety system.

Although shown and described herein with respect to overspeed safety systems connected to traveling components, such description is not to be limited. For example, the above described systems and processes may be applied equally to counterweights of elevator systems. In such embodiments, the counterweight overspeed safety systems may be configured to prevent an traveling component from traveling upward or accelerating upward too rapidly and/or to prevent free fall and damage caused by a counterweight overspeed or overacceleration event.

Advantageously, embodiments described herein provide overspeed safety systems that can provide controlled stopping of a traveling component in the event of a power failure. Further, embodiments provided herein prevent unnecessary or undesirable stops of the traveling component using overspeed safety systems. Advantageously, if power is restored without activation of the overspeed safety systems, normal operation of the elevator system may be resumed without manual intervention.

The terminology used herein is for the purpose of describing particular embodiments only and is not intended to be limiting of the present disclosure. The term "about" is intended to include the degree of error associated with measurement of the particular quantity and/or manufacturing tolerances based upon the equipment available at the time of filing the application. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An elevator system comprising:

a traveling component movable along a guide rail within an elevator shaft;

an elevator machine operably connected to the traveling component by one or more tension members, the elevator machine including a machine brake for stopping movement of the traveling component; and an overspeed safety system comprising:

a safety brake and an electromechanical actuator operably connected thereto, wherein the safety brake is operable to engage with the guide rail to stop movement of the traveling component;

a safety system controller operably connected to the electromechanical actuator, the control system configured to trigger the electromechanical actuator due to at least a detected triggering event; and a temporary power supply operably connected to the overspeed safety system;

wherein, during a power failure to the overspeed safety system, the temporary power supply supplies power to the overspeed safety system for a safety duration to prevent actuation of the safety brake and the elevator machine stops the traveling component within the elevator shaft, wherein the safety duration is a period of time that is longer than the maximum amount of time for the machine brake to stop the traveling component under normal operational circumstances, and wherein the safety system controller is configured to transition the electromechanical actuator from a first state to a second state, wherein in the second state, if the traveling component travels downward, the downward movement of the traveling component within the elevator shaft engages the safety brake with the guide rail to stop the downward movement of the traveling component.

2. The elevator system of claim 1, wherein the electromechanical actuator comprises:

a first magnetic element; and a second magnetic element, wherein the first magnetic element is configured to retain the second magnetic element thereto, and when the second magnetic element is not retained by the first magnetic element the second magnetic element is engageable with the guide rail.

3. The elevator system of claim 2, wherein when the second magnetic element is engaged with the guide rail, downward movement of the traveling component causes the safety brake to engage with the guide rail.

4. The elevator system of claim 3, wherein the first magnetic element is an electromagnetic coil and the second magnetic element is a permanent magnet.

5. The elevator system of claim 2, wherein the first magnetic element is an electromagnetic coil and the second magnetic element is a permanent magnet.

6. The elevator system of claim 2, wherein the safety duration is at least 3 seconds.

7. The elevator system of claim 1, further comprising:

an elevator controller; and a communication bus operably connecting the safety system controller with the elevator controller, wherein detection of the power failure is transmitted from the elevator controller to the safety system controller over the communication bus.

8. The elevator system of claim 7, wherein the safety duration is at least 3 seconds.

9. The elevator system of claim 7, further comprising an additional guide rail, an additional safety brake, and an additional electromechanical actuator operably connected thereto, wherein the additional safety brake is simultaneously operable with the safety brake to engage with the additional guide rail to stop movement of the traveling component.

10. The elevator system of claim 7, wherein the traveling component is one of an elevator car and a counterweight.

11. The elevator system of claim 1, wherein the safety duration is at least 3 seconds.

12. The elevator system of claim 1, wherein, at the end of the safety duration, the second magnetic element is transitioned to the second state.

13. The elevator system of claim 1, further comprising an additional guide rail, an additional safety brake, and an additional electromechanical actuator operably connected thereto, wherein the additional safety brake is simultaneously operable with the safety brake to engage with the additional guide rail to stop movement of the traveling component.

14. The elevator system of claim 1, wherein the traveling component is one of an elevator car and a counterweight.

15. A method for controlling operation of an elevator system, the method comprising:

detecting a power failure;

supplying power from a temporary power supply to an overspeed safety system for a safety duration to prevent actuation of a safety brake of the overspeed safety system, wherein the safety duration is a period of time that is longer than a maximum amount of time for a machine brake to stop a traveling component under normal operational circumstances;

applying the machine brake to stop movement of the traveling component; and transitioning an overspeed safety system from a first state to a second state, wherein in the second state, further downward movement of the traveling component within an elevator shaft engages the safety brake of the overspeed safety system with a guide rail to stop the downward movement of the traveling component.

16. The method of claim 15, wherein the safety duration is at least 3 seconds.

17. The method of claim 15, wherein, at the end of the safety duration, the second magnetic elements are transitioned to the second state.

18. The method of claim 15, further comprising transmitting information regarding a power failure from an elevator controller to the overspeed safety system over a communication bus.

19. The method of claim 15, further comprising, when power is restored, transitioning the overspeed safety system from the second state to the first state and resuming normal operation of the traveling component.

* * * * *